US008322925B2

(12) United States Patent
Soletski

(10) Patent No.: US 8,322,925 B2
(45) Date of Patent: Dec. 4, 2012

(54) FOOD BAG CONTAINING AN ABSORBENT SHEET

(76) Inventor: Michael M Soletski, Green Bay, WI (US)

( * ) Notice: Subject to any disclaimer, the term of this patent is extended or adjusted under 35 U.S.C. 154(b) by 320 days.

(21) Appl. No.: 12/648,168

(22) Filed: Dec. 28, 2009

(65) Prior Publication Data

US 2011/0158563 A1 Jun. 30, 2011

(51) Int. Cl.
*B65D 33/00* (2006.01)
*B65D 30/08* (2006.01)
*B65D 30/00* (2006.01)

(52) U.S. Cl. ..... 383/105; 383/111; 383/127

(58) Field of Classification Search ..... 383/105, 383/127, 111
See application file for complete search history.

(56) References Cited

U.S. PATENT DOCUMENTS

| | | | | |
|---|---|---|---|---|
| 560,469 | A | 5/1896 | Butts | |
| 1,975,404 | A | 10/1934 | Prucha | |
| 2,474,784 | A | 6/1949 | Golden | |
| 2,867,372 | A | 1/1959 | Fox | |
| 2,917,164 | A | 12/1959 | Kehr | |
| 3,429,718 | A | 2/1969 | Helms | |
| 4,941,756 | A | 7/1990 | Price | |
| 5,335,996 | A * | 8/1994 | Cortopassi et al. | 383/207 |
| 6,808,072 | B2 * | 10/2004 | Snedeker et al. | 206/542 |
| 2002/0066133 | A1 | 6/2002 | Frye | |
| 2004/0238381 | A1 * | 12/2004 | Rademaker | 206/216 |
| 2007/0090001 | A1 * | 4/2007 | Lipavsky | 206/223 |
| 2008/0038413 | A1 * | 2/2008 | Northrop | 426/107 |
| 2008/0237085 | A1 * | 10/2008 | Mills | 206/568 |
| 2010/0027919 | A1 * | 2/2010 | Faytre | 383/38 |

* cited by examiner

*Primary Examiner* — Jes F Pascua
(74) *Attorney, Agent, or Firm* — Steven H. Greenfield; Greenfield Invention and Patent Consulting Inc.

(57) ABSTRACT

A container comprising an absorbent sheet and methods for manufacturing the container are disclosed. The absorbent sheet is attached to the upper part of the container inside in a manner that is readily detachable when needed to clean a contamination or a spill. The absorbent sheet may cover one side to as many as all four sides of the container, have one or more plies, form a continuous sheet or cover any one side as individual sheets, and contain perforations to reduce the likelihood of tearing the sheet upon removal. A method for affixing the absorbent sheet to the container comprises spraying adhesive onto designated areas on the base container sheet and affixing absorbent sheets to the areas containing the adhesive prior to folding the container. In another embodiment, the method comprises spraying the adhesive and affixing the absorbent sheet after the container is folded.

5 Claims, 14 Drawing Sheets

FOOD BAG CONTAINING AN ABSORBENT SHEET

FIELD OF THE INVENTION

The present invention relates to a container used for holding and dispensing food and drink items. More specifically, the present invention relates to one or more absorbent sheets attached to a portion of a food bag that may be removed by the user for cleaning and wiping as needed. More specifically yet, the absorbent sheets are attached to an upper inside portion of the bag in a location where they are not likely to come in contact with, be soiled by, or get wet by the food and/or drink items placed inside the bag. Moreover, the present invention relates to methods for attaching the absorbent sheet to the bag.

BACKGROUND OF THE INVENTION

In a typical fast food transaction, food items and/or drink cups are placed into a container that is most typically a food bag made of paper or plastic or a combination of paper and plastic. The server will then insert one or more napkins into the food bag. The napkins may end up on top of the food and drink items or at the sides of the food and drink items. Often, these napkins come in contact with the food and become soiled and/or wet which may make them unusable. It would therefore be desirable to place napkins into a container used for storing foods and drink cups in a location and manner that makes it less likely for the napkins to accidentally come in contact with any of the food items or drink cups.

Prior art references disclose a number of embodiments for attaching a napkin to a bag or enclosing a napkin to a compartment which have the potential for solving this problem.

U.S. Pat. No. 3,429,718 teaches a 3-compartment package and a method of making it. The package comprises an envelope where the sides of the envelope can be sealed to each other. Seals extend across the envelope defining three rectangular pockets, each closed on all four sides of the respective rectangles. The three pockets contain sugar for a beverage, a stirrer for the beverage and a napkin. The respective pockets are opened by tearing open the respective pockets as desired to access the contained product.

U.S. Pat. No. 2,867,372 relates to a bag/pouch made from a multiple layer material, wherein a pocket is defined at the top of the bag/pouch and between two layers. Cards, instruction leaflets and the like can be placed in the pocket. A tear tab facilitates access to the pocket without opening the sealed top of the bag.

U.S. Pat. No. 2,917,164 refers to a paper or paper-like bag for enclosing a product. A separate pouch is attached to the bag blank and receives a thin promotional or gift card, or similar article. U.S. Pat. No. 2,474,784 shows a thin folded device structured somewhat like a wallet, designed to hold a short stack of folded facial tissue, and to dispense such facial tissue. The device can be carried in a handbag or purse in a compact orderly arrangement. A tissue can be dispensed from the dispenser without disturbing the other contents of the handbag or purse, and without disturbing the orderly arrangement of the reminder of the tissues.

U.S. Pat. No. 1,975,404 shows trapping an instruction sheet or the like between folds proximate, but displaced, from the top form the z-fold bag. The sheet is positioned adjacent an aperture in the wall of the bag, through which the sheet can be removed. The sheet is sealed closed, both at the top of the bag above the sheet, and below the sheet whereby the sheet can be removed from the bag through the aperture, without exposing the contents of the bag to the ambient environment.

U.S. Pat. No. 560,469 teaches an improved satchel having a plurality of pockets built into the walls of the satchel at the top of the satchel. Japanese patent JP 02003054575 teaches a packaging bag comprising a main bag with precooked food sealed, and an auxiliary bag/pocket integrated with the main bag so as to have an independent sealed space which contains a small damp towel.

US pre-grant publication 20020066133 teaches an adjustable disposable garment protector support adapted to support the garment protector from the neck of a user; a protector cover supported at its first end by the protector support in a position covering a front portion of the chest and stomach of the user; and, a pouch positioned on the second end of the protector cover, the pouch being formed to fold to one of a first closed position for storage and a second opened position having its top end opened and positioned to collect particulates and liquids moving downwardly along the front surface of the garment protector. The disposable garment protector may also be fabricated as a convertible food bag wherein a removable center section of the protector support is useable as at least one of: a napkin, a game sheet, an advertising display or a decorative display.

U.S. Pat. No. 4,941,756 discloses a bag for the storage and carrying of food with an attached napkin. The bag and the napkin are attached to each other by a seam or a glue line. The napkin may include a marker indicating where separation of the napkin should occur such as tearing, cutting or other manual action. The napkin may be folded and tucked into the bag following attachment. This structure has two drawbacks: 1) attaching the napkin to the top of the bag would likely require precise and thus costly registration of the glue line with the top of the bag; and 2) folding the napkin into the bag would result in an unattached bottom of the napkin inside the bag that makes portions of the napkin more likely to come in contact with the food and drinks placed in the bag.

SUMMARY OF THE PRESENT INVENTION

In one aspect of the present invention, a container comprises: a bottom and four sides, with the four sides consisting of a front side, a left side, a right side and a back side, with each side containing a top segment and a low segment, with each side also containing an outer portion and an inner portion; and at least one absorbent sheet attached to at least one top segment of an inner portion of a side.

In another aspect of the present invention, a method for attaching an absorbent sheet to a container inside comprises: providing a base sheet for making the container; conveying the base sheet to an adhesive application station; applying adhesive to areas on the sheet designated for affixing absorbent sheets; affixing at least one absorbent sheets onto areas on the base sheet containing adhesive; providing sufficient time for the adhesive to cure; conveying the base sheet containing the absorbent sheets to a slitting station; slitting the base sheet into individual container sheets; conveying each individual sheet to a folding station; and folding each individual sheet into individual containers.

In yet another aspect of the present invention, a method for attaching an absorbent sheet to a container inside comprises: providing a container having a bottom and four sides, with the four sides consisting of a front side, a left side, a right side and a back side, with each side containing a top segment and a low segment, with each side also containing an outer portion and an inner portion; applying adhesive to a designated area of the inner portion of the top segment of at least one of the four sides; attaching at least one absorbent sheet to any area containing adhesive; and providing sufficient time for the adhesive to cure.

These and other features, aspects and advantages of the present invention will become better understood with reference to the following drawings, description and claims.

DETAILED DESCRIPTION OF THE INVENTION

Figure 1:
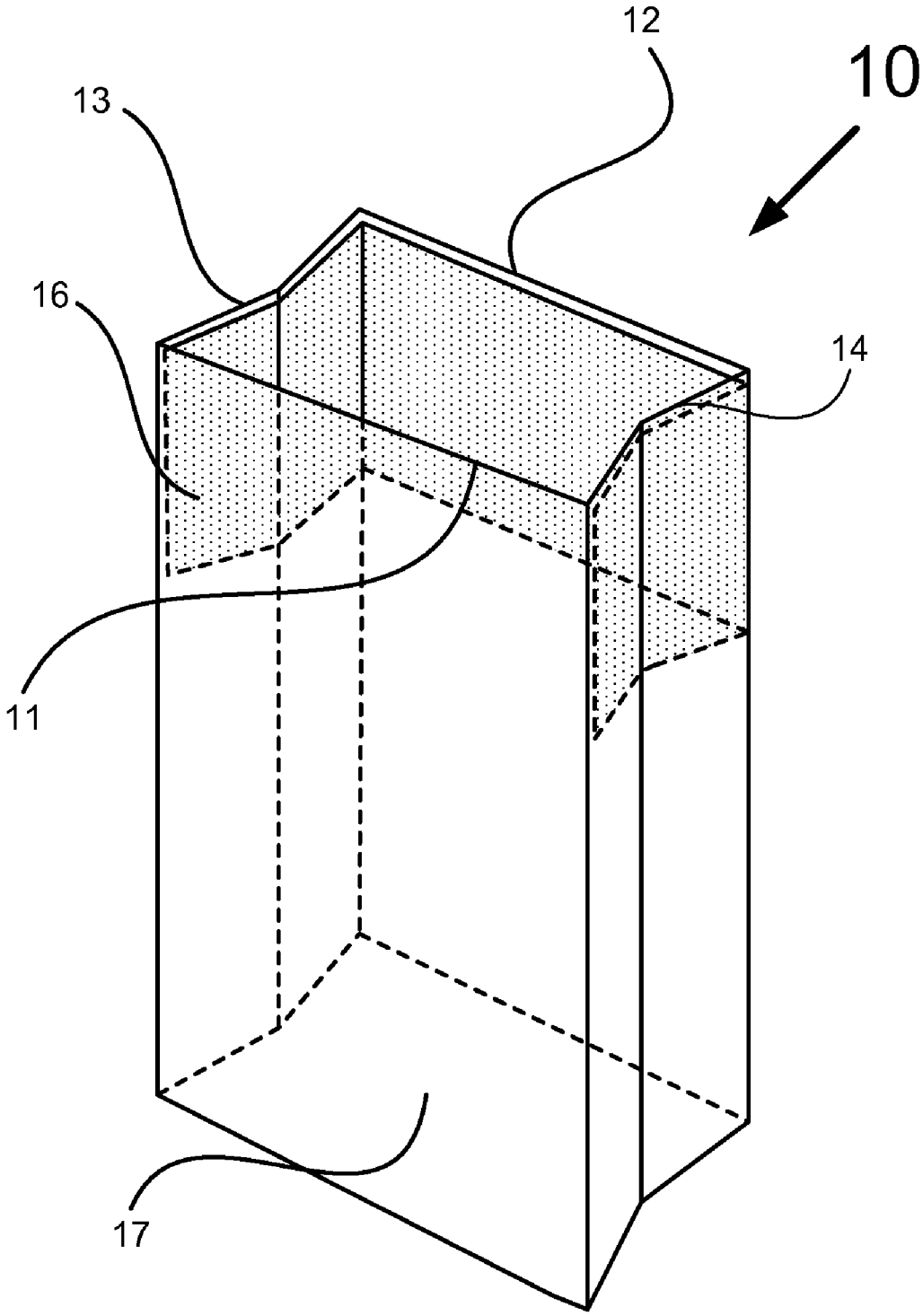
FIG. 1 is a front side isometric view of a food bag showing a three sided absorbent sheet according to an embodiment of the present invention.

The container of the present invention comprises a closed bottom, and open top and four sides. The container may be used for storing items that have a potential for contaminating the surroundings of the container interior as well as soiling a user that may come in contact with these items. Examples include but are not limited to, chemicals, cosmetics, food, liquids such as drinks or other items that have the potential of contaminating the storage surroundings if they accidentally spill. A more specific example of such a container is a food bag containing food and beverage items dispensed at fast food establishments. The food items may contain condiments such as ketchup or mayonnaise that may spill into the container or get onto the consumer. In such situations, having a clean and handy absorbent sheet to wipe the soil or spill would be beneficial. The sheet may be paper towel or napkin, but cloth is also within the scope of the present invention.

Therefore, the object of the present invention is to provide a handy absorbent sheet for cleaning accidental spills and contaminations that originate from items stored or designated for storage in a container.

Containers, and more specifically food bags are often constructed having a bottom, an open top and four sides that may be arranged to correspond to a left side, a back side, a right side and a front side. These sides are constructed to each connect with an adjacent side. The sides generally have a top segment close to the open top and a low segment close to the bottom. Also the sides of such containers typically possess identifiable inner portions and outer portions. In an embodiment of the present invention, one or more absorbent sheets are attached to the upper segment of the inside portion of at least one side of the container. It will be appreciated by those skilled in the art, that one or multiple absorbent sheets may be attached in a variety of fashions that fall within the scope of the present invention. A continuous absorbent sheet may be attached to all four sides. The height of the absorbent sheet may range from about 2 inches to about 7 inches depending on the size of the bag and the anticipated application. In another embodiment of the present invention, individual sheets are attached to the upper segment inner portion of one or more of the sides. In yet another embodiment of the present invention, more than one absorbent sheet may be used. For example, the sheet may have multiple plies, typically two or three.

Attachment of the absorbent sheet to the top segment inner portion of the container may be accomplished using a number of adhesives and adhesive application patterns. The preferred adhesive is water based latex using such formulations as vinyl acetate, acrylics and urethanes. These adhesives may be sprayed onto areas of the top segment inner portion of the container in droplet form and typically cure quickly after the absorbent sheet is attached to the areas containing adhesive. However other types of adhesives also fall within the scope of the present invention. A light and sparse spray pattern of adhesive droplets keeps the absorbent sheet firmly attached to the container side, yet it may be removed intact using a firm hand pull. The adhesive may be applied in other patterns and forms such as strips or dense sprays around the side edges of the absorbent sheet.

Detaching the absorbent sheet may be accomplished by pulling off the sheet by hand. The sides of the sheets adjacent to the interface between the sides may contain perforations that facilitate detachment at these perforations and that reduce the probability of tearing of the absorbent sheet when detaching.

The number of the absorbent sheets, the various possible sizes and distribution among the sides are designed to provide size selection options for the user. For example, a consumer of food placed in a food bag may only need a small sheet to wipe a small spill. Attaching individual sheets to the inside the bag allows the consumer to use only what he/she needs and save the other sheets for later if needed.

Figure 2:
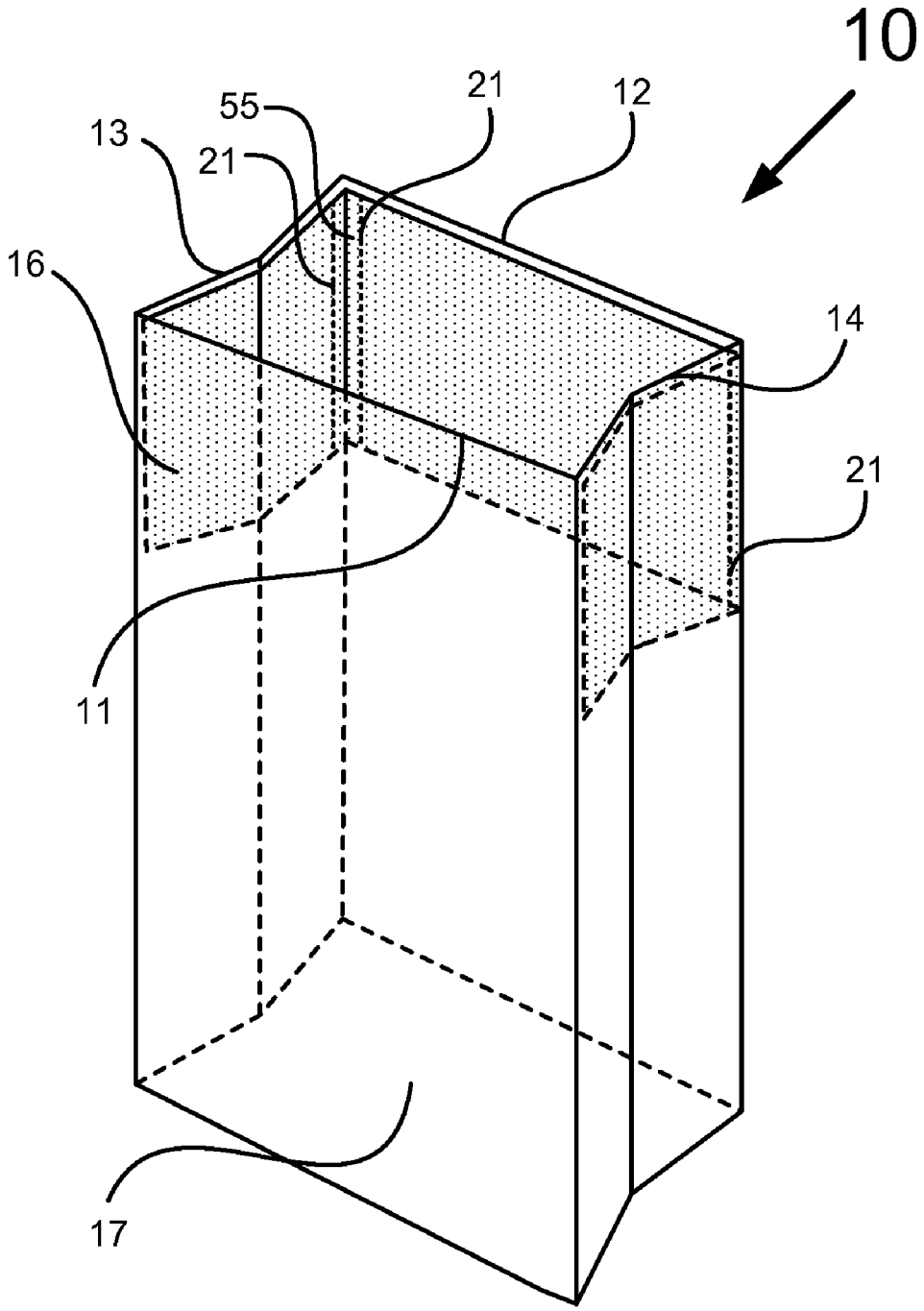
FIG. 2 is another front side isometric view of a food bag showing a three sided absorbent sheet comprising perforations to facilitate removal of the absorbent sheet according to an embodiment of the present invention.
Figure 3:
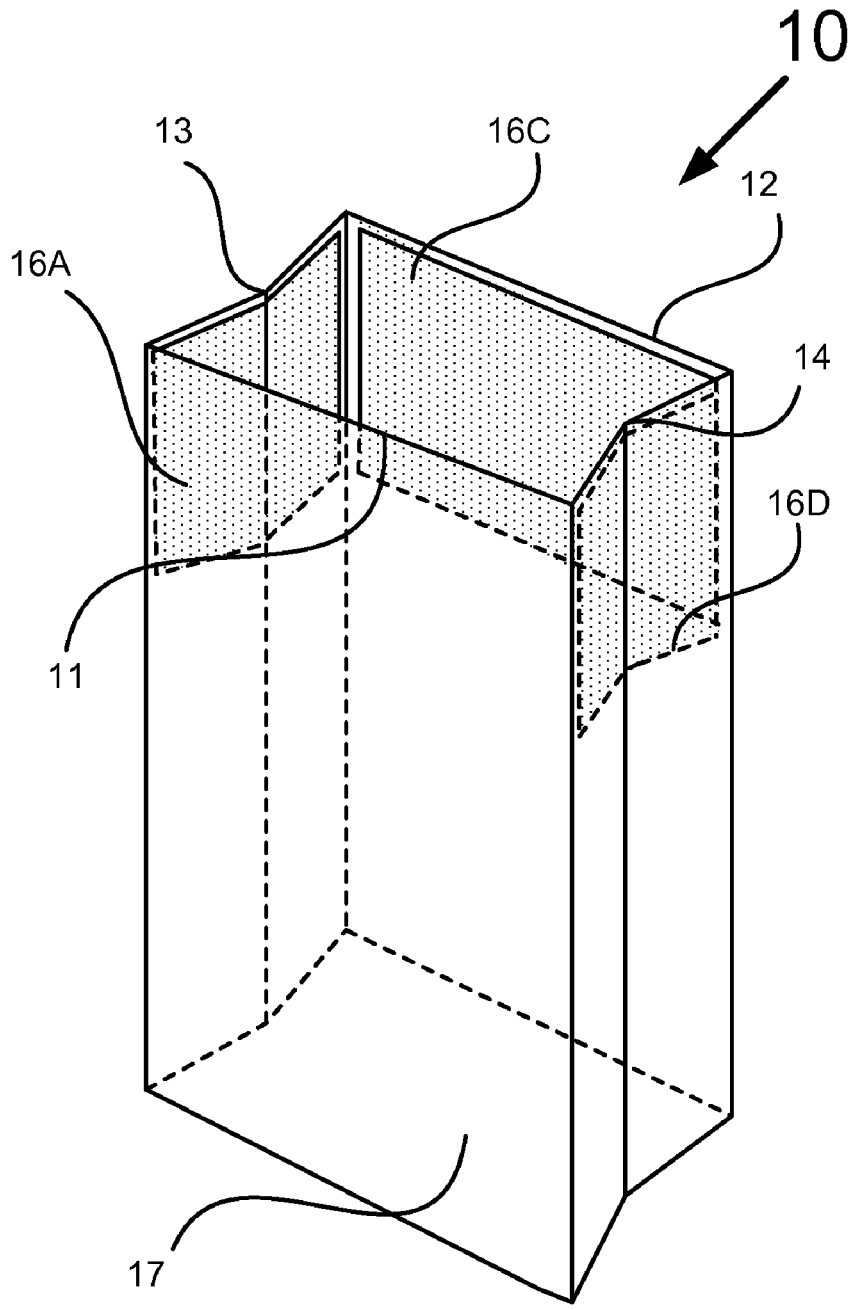
FIG. 3 is a front side isometric view of a food bag showing three separate absorbent sheets according to an embodiment of the present invention.
Figure 4:
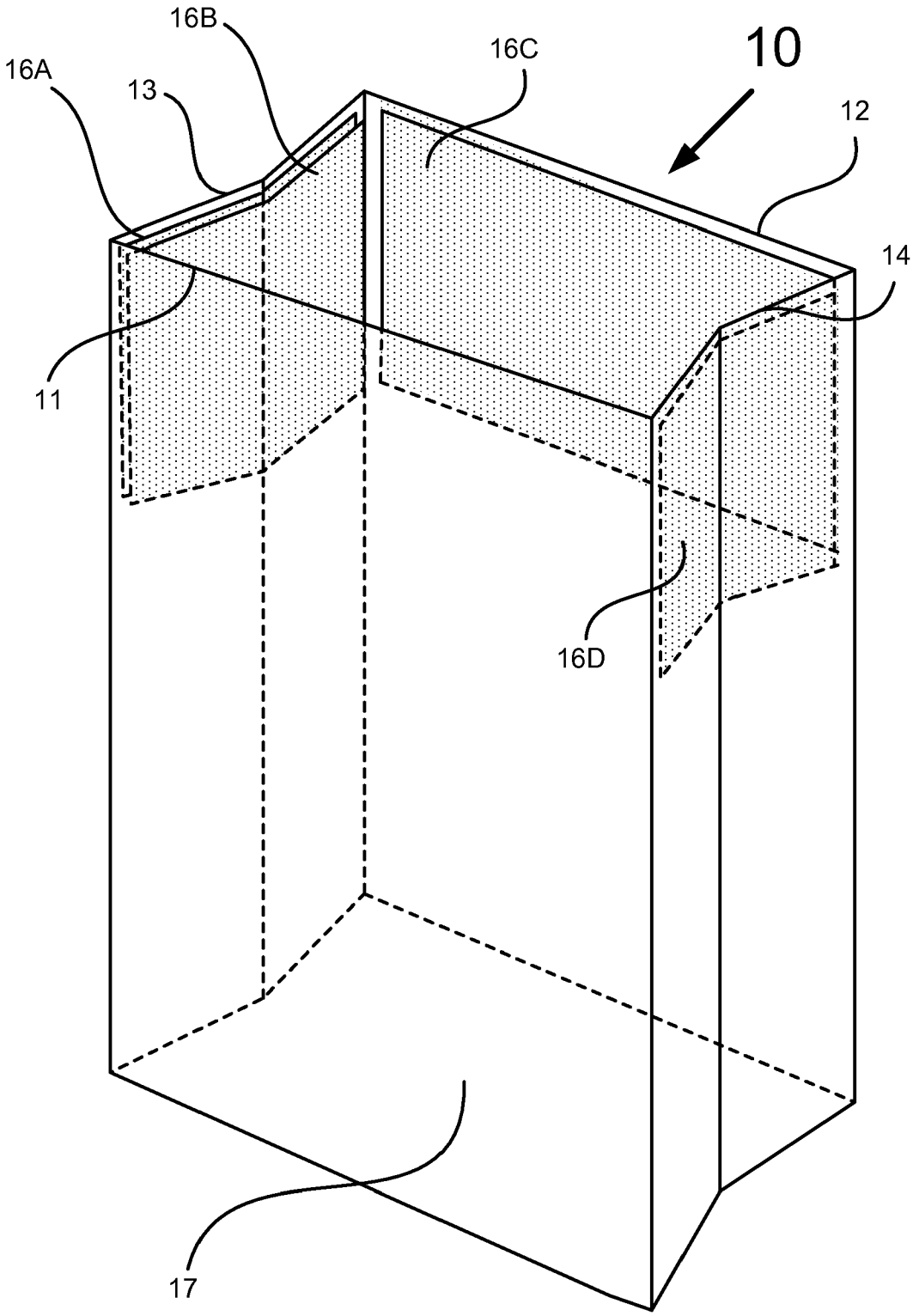
FIG. 4 is a front side isometric view of a food bag showing two separate absorbent sheets and one double sheet according to an embodiment of the present invention.
Figure 5:
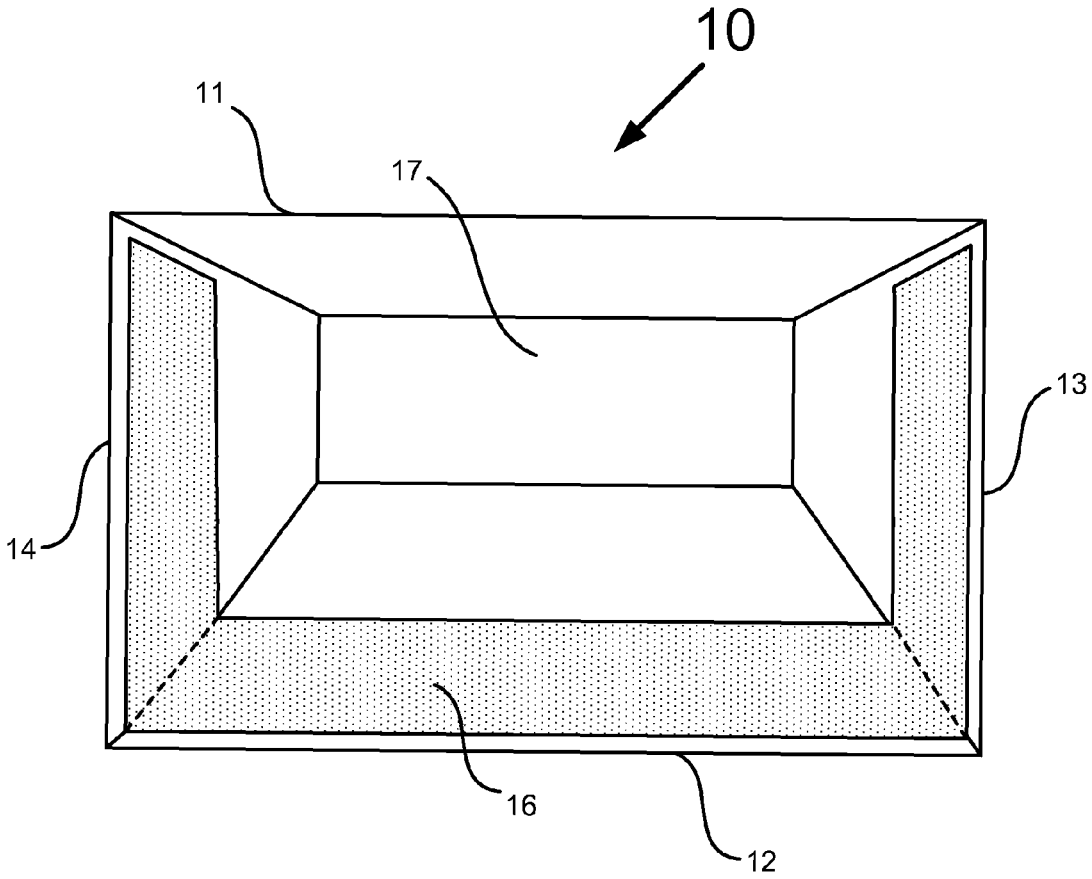
FIG. 5 is a top view of a food bag showing a three sided absorbent sheet according to an embodiment of the present invention.
Figure 6:
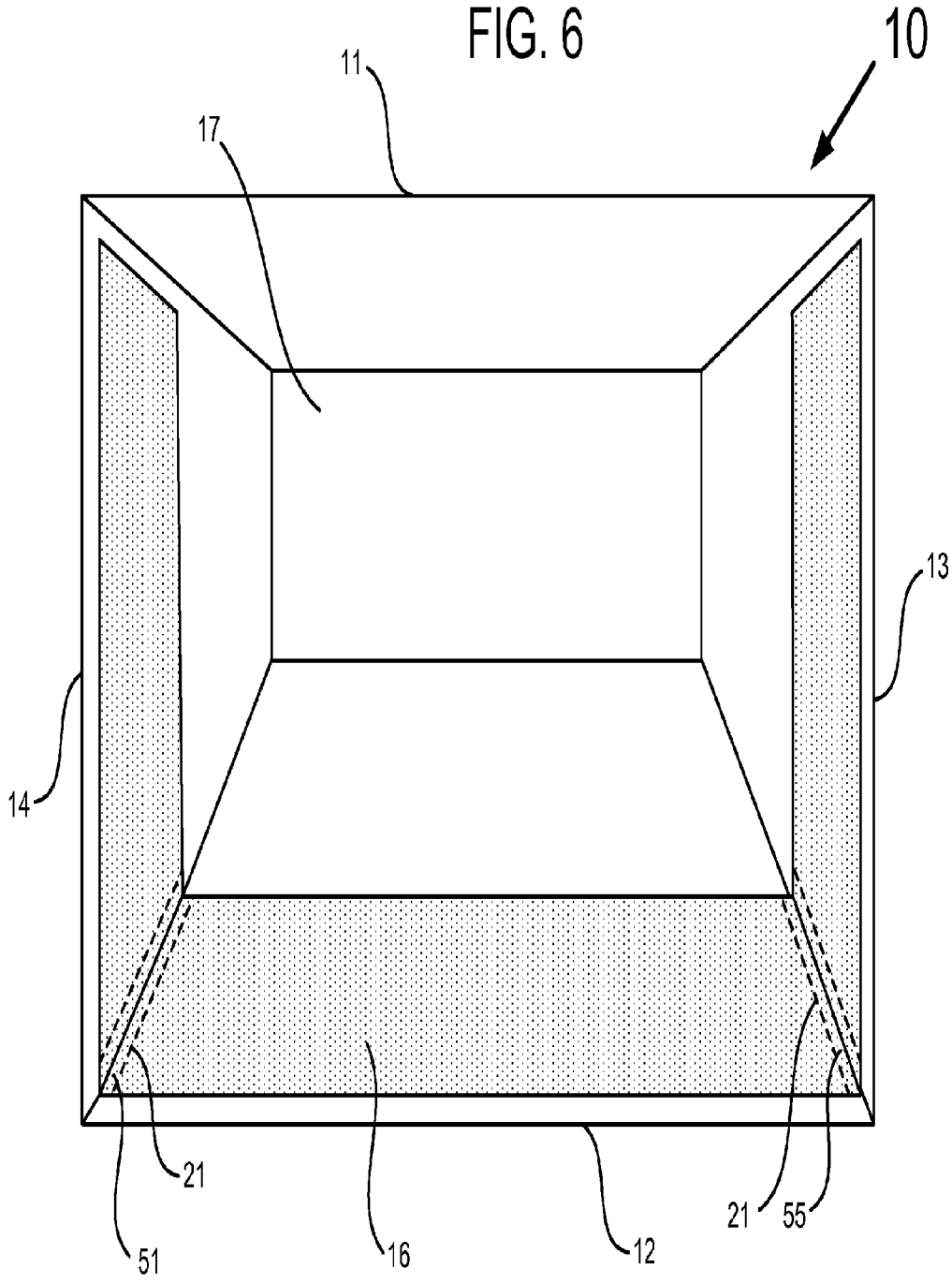
FIG. 6 is a top view of a food bag showing a three sided absorbent sheet comprising perforations to facilitate removal of the absorbent sheet according to an embodiment of the present invention.

Shown in FIGS. 1-12 illustrate the front and top views of a food bag 10 featuring a front side 11, a back side 12, a left side 13 and a right side 14. In FIGS. 1 and 5, a continuous absorbent sheet 16 is attached to the back side 12, left side 13 and right side 14. FIGS. 2 and 6 show a continuous absorbent sheet 16 attached to the back side 12, left side 13 and right side

Figure 7:
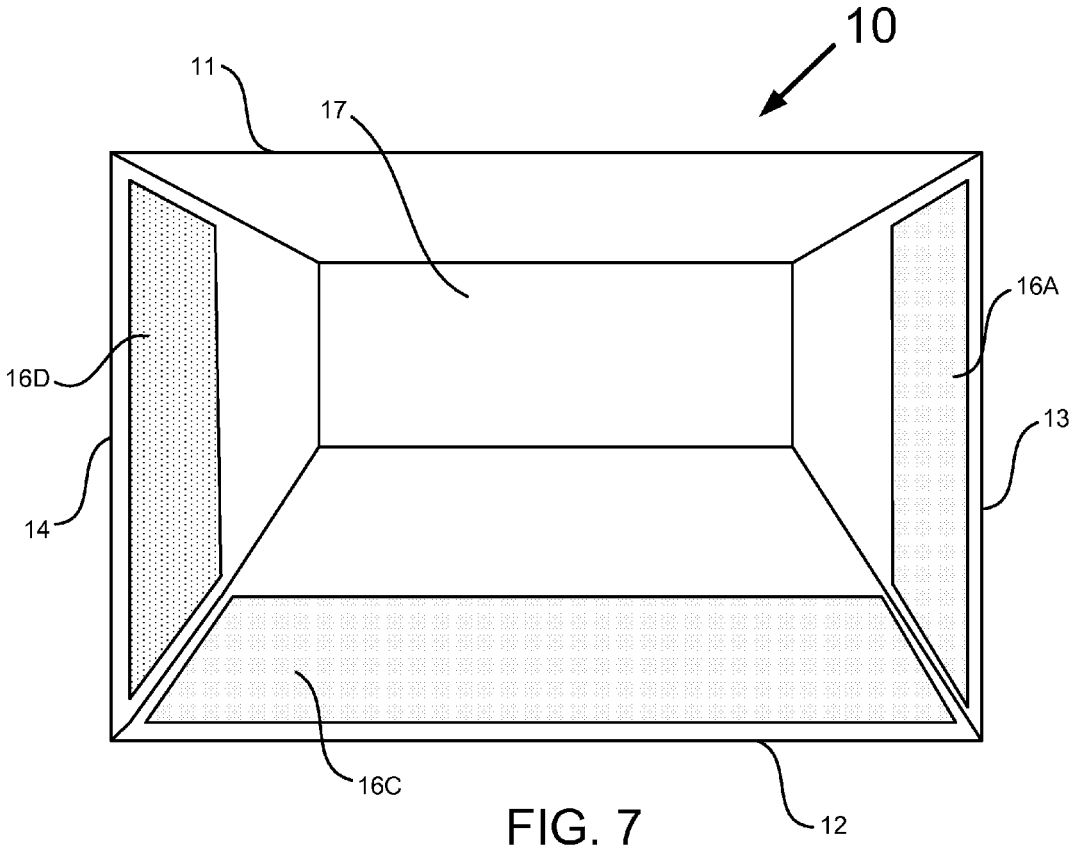
FIG. 7 is a top view of a food bag showing three separate absorbent sheets according to an embodiment of the present invention.
Figure 8:
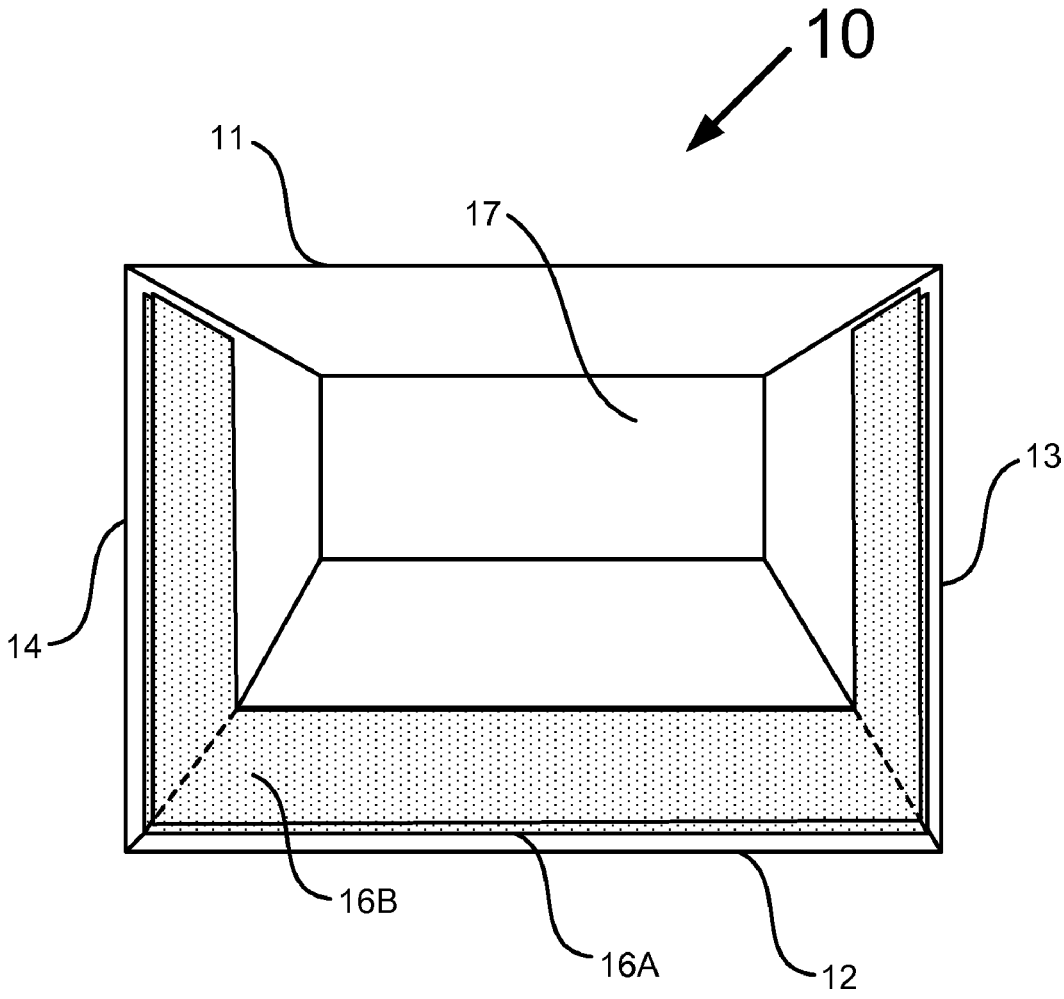
FIG. 8 is a top view of a food bag showing a continuous absorbent sheet made of two plies that is attached to three sides of the bag interior according to an embodiment of the present invention.
Figure 9:
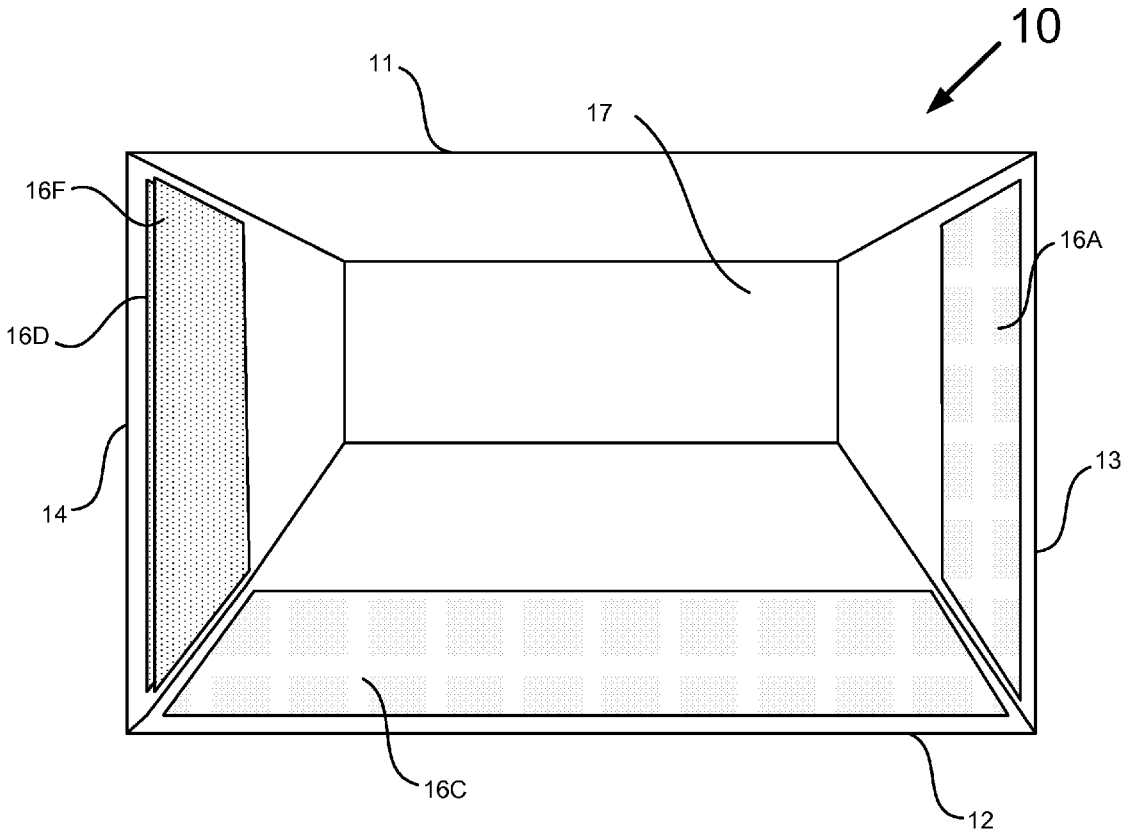
FIG. 9 is a top view of a food bag showing two separate absorbent sheets and one double sheet according to an embodiment of the present invention.
Figure 10:
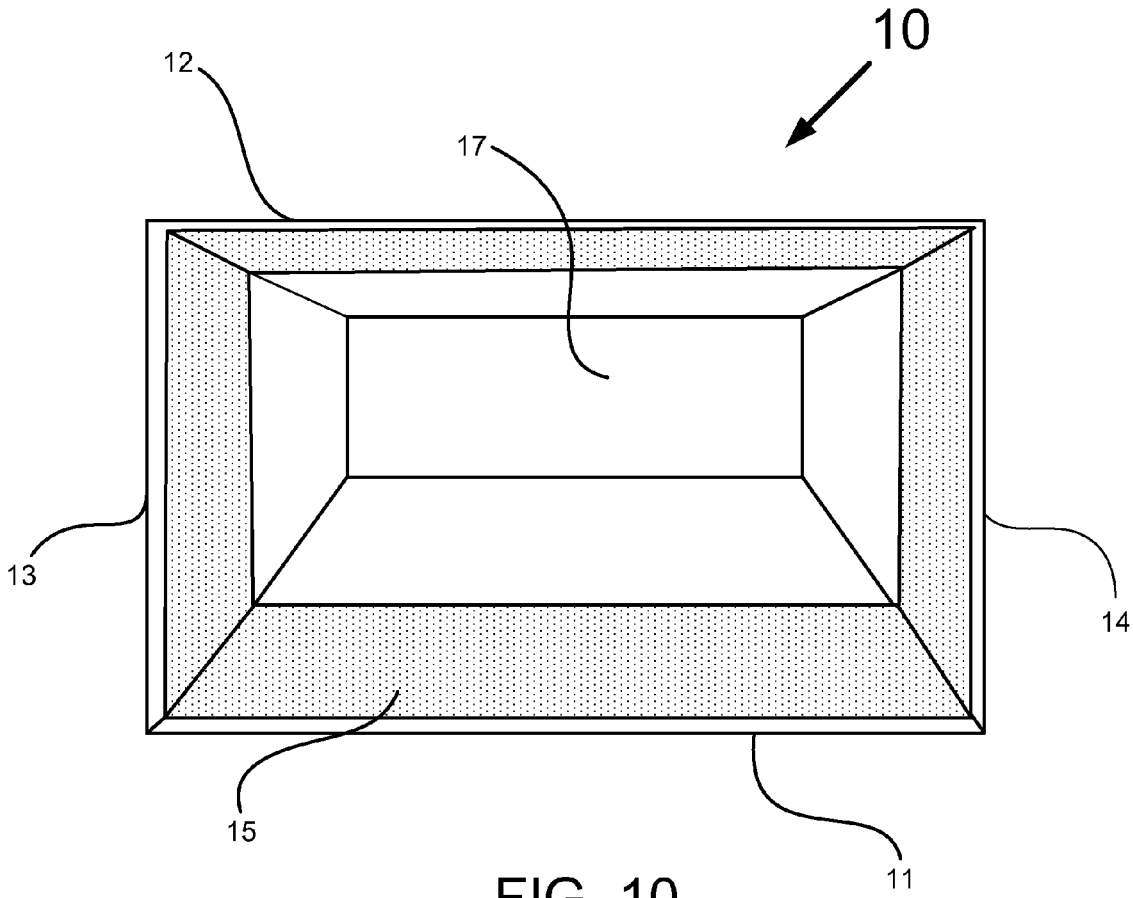
FIG. 10 is a top view of a food bag showing an absorbent sheet covering all four sides of the food bag according to an embodiment of the present invention.
Figure 11:
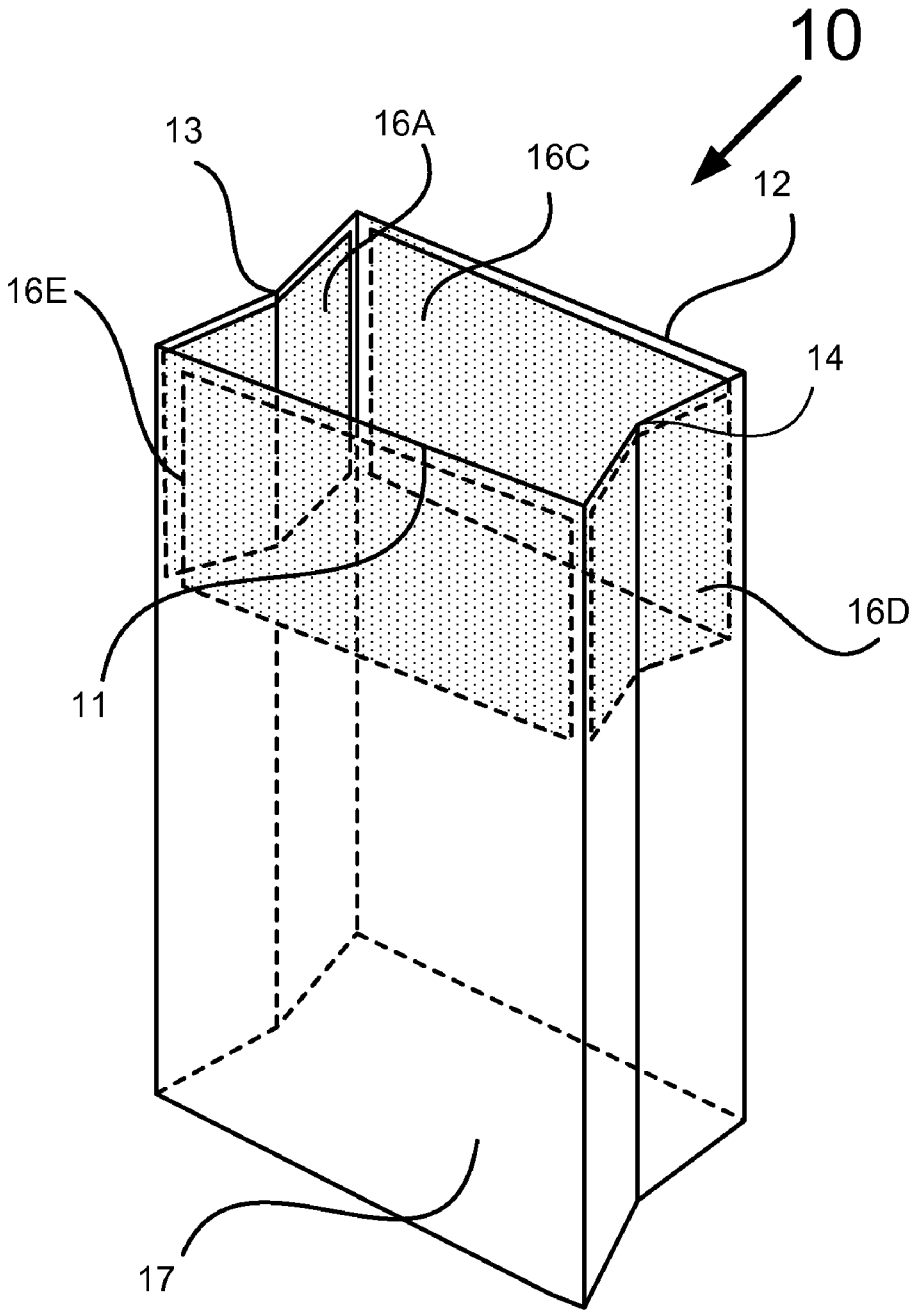
FIG. 11 is a front side isometric view of a food bag showing four separate absorbent sheets according to an embodiment of the present invention.
Figure 12:
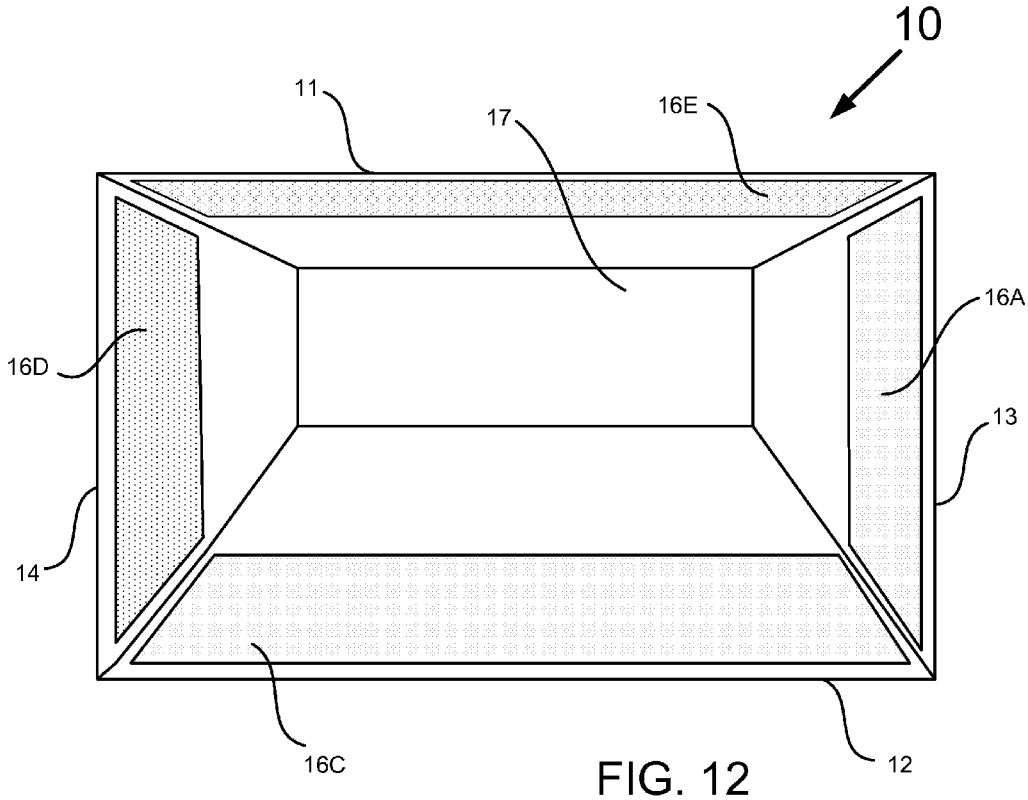
FIG. 12 is a top view of a food bag showing four separate absorbent sheets according to an embodiment of the present invention.

14 of the food bag 10. The absorbent sheet is attached to strips 51 and 55 by perforations 21 disposed at the junctions of the sides to reduce the likelihood of tearing the absorbent sheet when it is detached. FIGS. 3 and 7 depict three individual and separate sheets 16A, 16C and 16D attached to the left, back and right sides respectively. In FIG. 4, a double sheet is attached to the left side of the container representing, as an example, a two ply sheet having plies 16A and 16B. FIG. 8 features a continuous two ply absorbent sheet attached to the inside of the food bag 10. The inner ply in contact with the container is 16A while the outer ply is 16B. FIG. 9 illustrates individual sheets on the back side 16C, and left side 16A, and a two ply sheet 16D and 16F attached to the right side of the food bag 10. FIG. 10 depicts a continuous sheet 15 that spans all four sides of the inside of the food bag 10. FIGS. 11 and 12 show individual sheets 16A, 16C, 16D and 16E attached to all fours sides of the food bag 10.

In an embodiment of a method for manufacturing a container comprising an absorbent sheet attached to the inside of the container 20, a base sheet is unwound from a roll and conveyed to an adhesive application station. A computer receives data from a speed sensor and determines the timing and location for applying the adhesive. The computer then sends commands for activating the sprayer at appropriate times. Absorbent sheets that are pre-cut to size are dispensed and affixed using a mechanical arm that picks up one sheet at a time, then lays and presses it on the designated area containing the adhesive. This function is also computer controlled. This is followed by conveying the base sheet for a time period sufficient for the adhesive to cure and conveying the base sheet to a slitting and assembly station where the base sheet is slit into predetermined individual container sheets which are then folded and assembled into containers.

Figure 13:
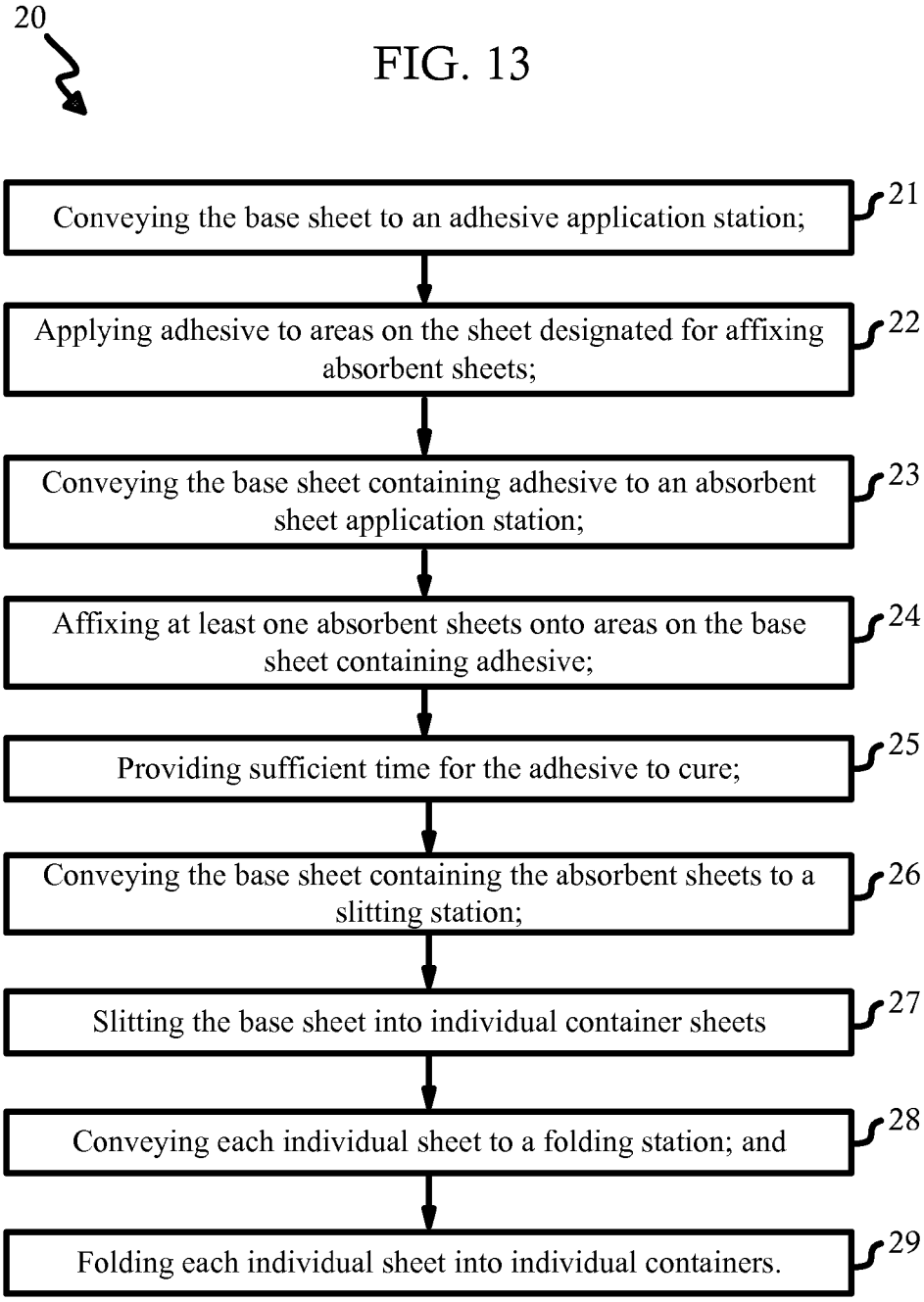
FIG. 13 is a flow chart of a method for manufacturing a container comprising an absorbent sheet according to an embodiment of the present invention.

FIG. 13 is a flow chart of this method for manufacturing the container comprising an absorbent sheet 20.

In another embodiment of a method for manufacturing a container comprising an absorbent sheet attached to the inside of the container 30, the absorbent sheet is attached to the inside of the assembled container. Adhesive is sprayed through the open top of the container onto the area designated for attaching the absorbent sheet. A mechanical arm that holds the absorbent sheet is inserted through the opening of the container and is adapted to move the absorbent sheet and attach it to the area containing the adhesive while a separate arm supports the container. The adhesive is then allowed to cure in order to solidify the bond between the container and absorbent sheet.

Figure 14:
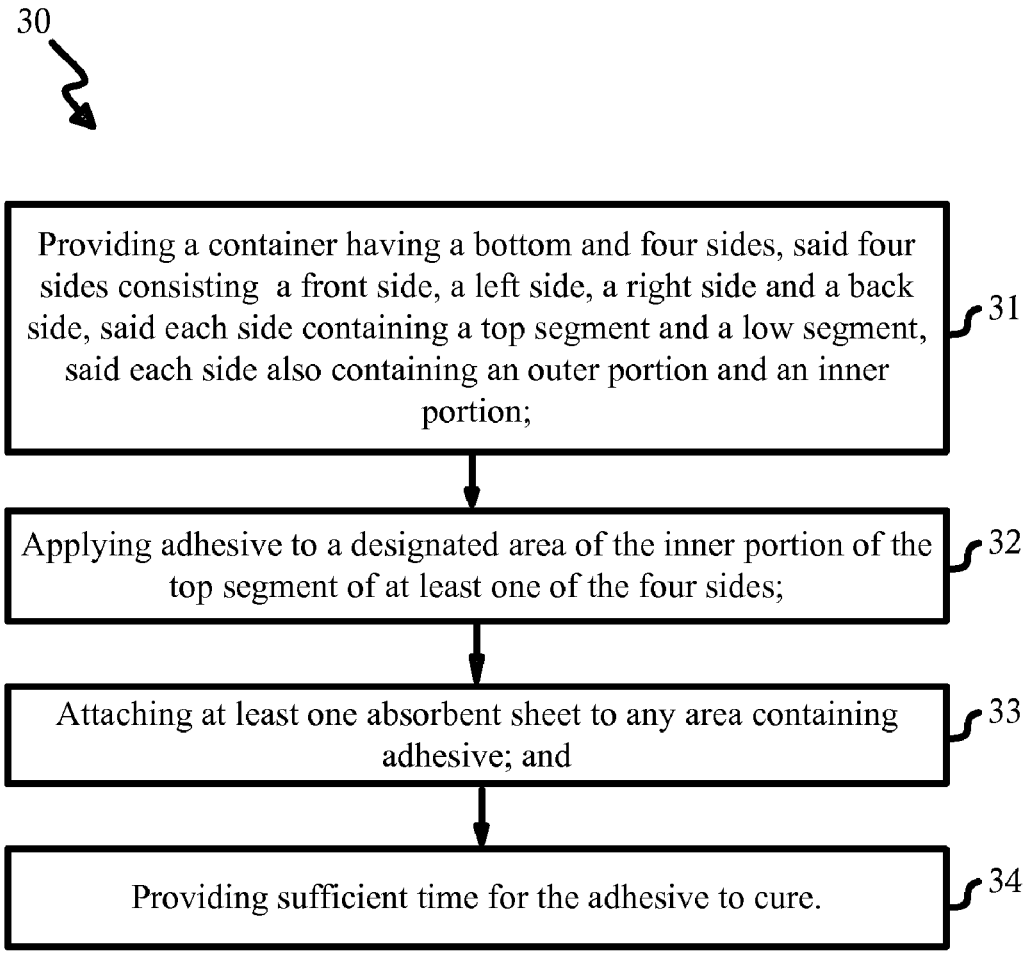
FIG. 14 is a flow chart of another method for manufacturing a container comprising an absorbent sheet according to an embodiment of the present invention.

FIG. 14 is a flow chart of this method for manufacturing the container comprising an absorbent sheet 30.

I claim:

1. A container consisting:

a bottom, an open top and four sides, said four sides consisting a front side, a left side, a right side and a back side, said each side containing a corresponding top segment and a low segment, said each side also containing an outer portion and an inner portion;

at least one absorbent sheet attached to only the corresponding top segment of the inner portion of a side of the container, said container containing no perforations; and wherein the absorbent sheet consists of:

a continuous portion having a first edge and a second edge;

a first strip attached to the first edge of the absorbent sheet by a first perforation, wherein only a surface of the first strip is attached to the corresponding top segment of the inner portion of the container by adhesive; and a second absorbent strip attached to the second edge of the absorbent sheet by a second perforation, wherein only a surface of the second absorbent strip is attached to the corresponding top segment of the inner portion of the container by adhesive, and a section of the inner portion of the container covered by the continuous portion of the absorbent sheet is free of adhesive;

said continuous portion of the absorbent sheet being unattached to the corresponding top segment of the inner portion of the container;

said continuous portion of the absorbent sheet being configured for tearing off from the first strip at the first perforation and configured for tearing off from the second strip at the second perforation, said continuous portion of the absorbent sheet being removable from the container in an intact form by a firm hand pull.

2. The container of claim 1, wherein one absorbent sheet is attached only to the top segment of the inner portion of the right side of the container.

3. The container of claim 1 wherein one absorbent sheet is attached only to the top segment of the inner portion of the left side of the container.

4. The container of claim 1 wherein one absorbent sheet is attached only to the top segment of the inner portion of the front side of the container.

5. The container of claim 1 wherein one absorbent sheet is attached only to the top segment of the inner portion of the back side of the container.

* * * * *